US005452572A

United States Patent [19]

Alvaro et al.

[11] Patent Number: 5,452,572

[45] Date of Patent: Sep. 26, 1995

[54] HOLLOW ROPE CHAIN WITH CLOSE FITTED LINKS

[75] Inventors: Badi Alvaro, Talpiot; Benjamin Hillel, Jerusalem, both of Israel

[73] Assignee: Adipaz Ltd., Jerusalem Talpiot, Israel

[21] Appl. No.: 368,033

[22] Filed: Jan. 3, 1995

[51] Int. Cl.[6] ..... B21L 5/02

[52] U.S. Cl. ..... 59/80; 59/3; 59/83

[58] Field of Search ..... 59/1, 3, 80, 84, 59/83

[56] References Cited

U.S. PATENT DOCUMENTS

| | | | |
|---|---|---|---|
| 4,651,517 | 3/1987 | Benhamou et al. | 59/80 |
| 5,185,995 | 2/1993 | Dal Monte | 59/80 |
| 5,303,540 | 4/1994 | Rozenwasser | 59/80 |
| 5,353,584 | 10/1994 | Strobel et al. | 59/80 |
| 5,361,575 | 11/1994 | Rozenwasser | 59/80 |

*Primary Examiner*—David Jones
*Attorney, Agent, or Firm*—Helfgott & Karas

[57] ABSTRACT

A rope chain is made from hollow rectangular links having a trapezoidal cross section. The wider parallel surface of the trapezoid is the outer periphery of the shaped link and is the primary surface of the finished rope chain. The narrower parallel surface of the trapezoidal shape, having a channel which forms a longitudinal seam running around the inside of the link, is an inside surface of the finished rope chain and is not visible in a finished chain. The other two sides of the trapezoid converge in symmetrical relationship to the parallel surfaces, and include an angle that approximately equals 360° divided by the number of links required to form a single cycle of links in a double helix, as viewed in an end view of the rope chain. Adjacent links abut, planar surface to planar surface, and form a close fitting circle with a smooth external surface for the rope chain.

11 Claims, 4 Drawing Sheets

HOLLOW ROPE CHAIN WITH CLOSE FITTED LINKS

BACKGROUND OF THE INVENTION

This invention relates generally to rope chain jewelry and more particularly to rope chain jewelry of the hollow type.

A rope chain may be made up of annular links formed of solid wire, usually a precious metal such as gold. The wire is formed in links, with each link generally having an overall C-shape to define a gap in the annular periphery. In a known manner, a multiplicity of such individual links are intertwined to form, in outward appearance, a double helix rope chain.

In order to reduce the weight of precious metal and thereby reduce the cost of a finished item without any compromise in aesthetic appearance, rope chains are now made using hollow links. After formation, the individual hollow links are intertwined, just as the solid links are intertwined, to form what is known as the hollow rope chain.

Different appearances have been achieved for the solid link rope chains by using links of different cross sections. This is effected by assembling the chain from links that are pre-shaped with special cross sectional configurations other than conventional circular and oval shapes. Also, after a solid rope chain has been fabricated, cross sections of conventional shape have been varied in the prior art by techniques known in the trade as diamond cutting. In these techniques external portions of solid links are sheared away to produce many attractive patterns. Further, again with the motive to provide a less costly rope chain that gives the same appearance as a solid link rope chain, techniques have been developed for faceting hollow link chains by deforming the outer surface without removal of material.

Additionally, unique appearances for rope chains have been created by using links that are not C-shaped before being intertwined to form a rope chain. The links may be square in shape, rectangular, hexagonal, or of other shapes that can be fabricated with a gap in the perimeter and a open central area such that links of similar shape may be intertwined in the known manner to form the double helix of a rope chain.

Unfortunately, because all of the rope chains, whether solid or hollow and regardless of the link shape, present an outer surface with one link lying adjacent to another link, and so on around the double helix, many chains have a corrugated look which results from the cross section of the solid or hollow links and the type of contact, e.g. point, linear or surface to surface, between adjacent links.

The patent to Dal Monte, U.S. Pat. No. 5,185,995, issued Feb. 16, 1993, addresses this problem for solid links in order to provide a rope chain having a smooth, tight and non-corrugated appearance. However, there is no indication that the principles of his invention can be successfully applied to hollow links of any type. In fact, the use of hollow wire is discouraged as difficult and costly to produce (col. 5, lines 44–48).

What is needed is a rope chain made of hollow links that is also smooth and close fitting, without a corrugated surface.

SUMMARY OF THE INVENTION

Accordingly, it is an object of the invention to provide an improved hollow rope chain with tight, close fitted links that do not present a corrugated surface.

Yet another object of the invention is to provide an improved hollow rope chain comprised of links that are contoured for close fit with adjacent links and are economical to produce.

Another object is to provide an improved hollow rope chain using non-round links that are strong and resistant to unwanted bending and deformation of the appearance surfaces.

A rope chain in accordance with the invention is made from hollow rectangular links having a trapezoidal cross section. The wider parallel surface of the trapezoidal shape is the outer periphery of the shaped link, that is, the primary surface seen by an observer of the finished rope chain.

The narrower parallel surface of the trapezoidal shape, having a channel which forms a longitudinal seam running around the inside of the link, is an inside surface of the finished rope chain and is not visible to an observer. The other two sides of the trapezoid converge in symmetrical relationship to the parallel surfaces, and have an included angle of taper. The angle approximately equals 360° divided by the number of links required to form a circle, that is, a single cycle of links in the double helix, as viewed along a longitudinal axis (end view) of the rope chain. Accordingly, adjacent links abut, planar surface to planar surface, and thereby form a smooth, complete circle in an end view without substantial discontinuities at the interfaces and without a corrugated look on the external surface of the rope chain.

In alternative embodiments, the links may be square shaped, C-shaped, octagonally shaped, etc. and fabricated using techniques known in the art. Also, the appearance surface of the links need not be a single plane.

The inner parallel surface of the trapezoid cross section provides metal in a position that increases the strength of the hollow link when compressive forces on the outer surface of the rope chain tend to produce tension forces on the inner surfaces adjacent to the open seam of the link. Thus, a stronger hollow link and a stronger rope chain is provided.

This invention accordingly comprises the features of construction, combination of elements and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings in which.

DESCRIPTION OF PREFERRED EMBODIMENTS

Figure 1:
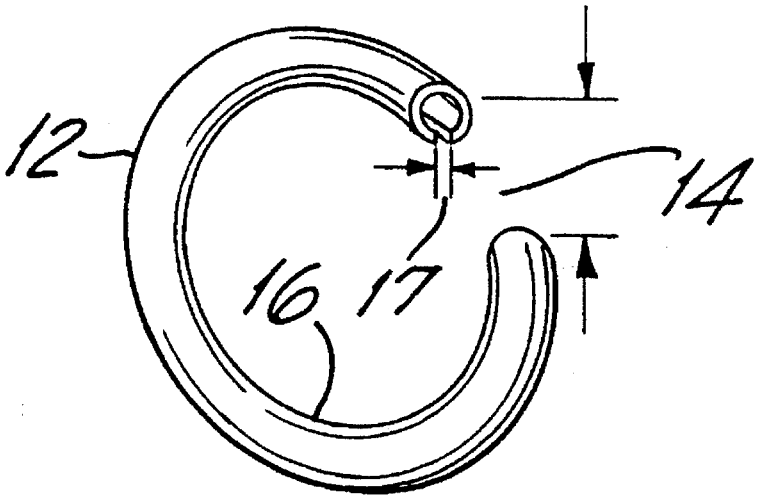
(PRIOR ART) FIG. 1
FIG. 1 is a typical link used in construction of a jewelry rope chain in accordance with the prior art.
Figure 2:
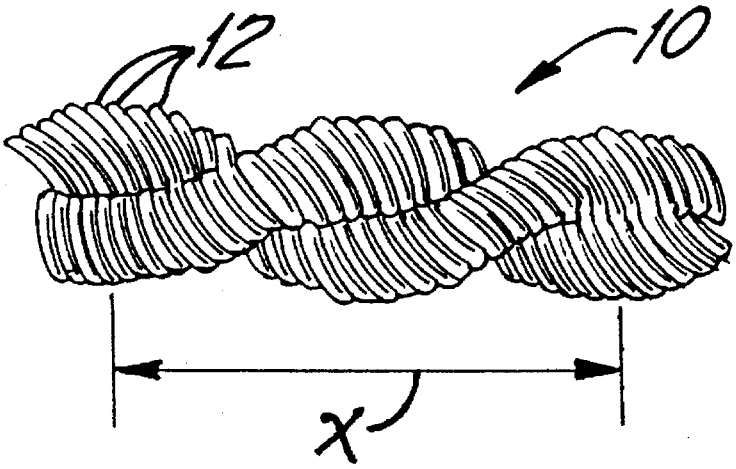
(PRIOR ART) FIG 2
FIG. 2 is a segment of a jewelry rope chain of the prior art, formed of links as in FIG. 1.

FIG. 2 illustrates a segment of a double-helix rope chain 10 as is used to make necklaces, bracelets, and the like. Constructions of rope chains are well known in the jewelry arts. The rope chain 10 is made by intertwining many similar links 12. Each link, as illustrated in FIG. 1, is a hollow toroid with a gap 14 between the ends of the link and a longitudinal seam 16 running around the inside of the link such that the link 12 is similar to an automobile tire except that a segment is missing from the circumference. A rope chain 10 made from such links 12 is known as a hollow link rope chain.

The links 12 are made by taking a flat sheet of thin precious metal, for example, gold, and wrapping it around a non-precious core wire which may be aluminum or copper, leaving the open seam 16 defining a second gap 17. The elongated rod, thus formed, is then wrapped around a mandrel (not shown) in a spiral-like fashion and is cut into sections to form the links with the small gap 14. The links are typically flattened so that they lie in a plane. The core is removed by melting or by action of an acid or caustic soda as is appropriate to the non-precious metal used for the core. The seam 16 allows for a faster chemical process. The completed links 12 are then intertwined in the known manner to make the rope chain 10.

The order of steps described above may be varied and the thin layer of precious metal may be applied to a solid non-precious core by other known techniques, for example, by drawing a core and thin sheet of precious metal through a round die as described in U.S. Pat. No. 5,129,220, so that the sheet of precious metal forms a tube with a non-precious core.

U.S. Pat. No. 4,651,517 to Benhamou gives details of techniques used in intertwining links with a hollow or solid cross section to form a rope chain. Such rope chains can be formed with links of other shapes, that is, the C-shape of FIG. 1 can be replaced with a square or rectangular shape, an oval, hexagon, octagon, etc. so long as a gap 14 is provided and sufficient interior space is provided which permits intertwining of links to form the double helix chain.

The patents mentioned above are incorporated herein by reference.

In addition to many peripheral link shapes, the cross sectional shapes of the links have also been varied. Where links are solid, it is relatively easy to provide different cross sections. The Dal Monte patent teaches many different cross sections including triangular.

Use of different cross sectional shapes has been adopted, as in Dal Monte, to reduce the amount of precious metal required for the links and, therefore, for the resultant rope chain. There has been a problem when links with a round or oval cross section are intertwined to form a chain rope in the conventional manner. Then, adjacent links frequently make line or point contact which results in a loose, non-smooth, that is, somewhat corrugated, surface for the outer periphery of the rope chain. By placing the majority of the metal weight close to the outside perimeter of the solid link cross section, Dal Monte is able to provide better nesting with smooth surfaces, that is, a more close-packed arrangement as viewed longitudinally from the end of the chain, as compared with the links of round and oval cross section. These shapes also save in weight of precious material.

Whereas the cross sectional shapes of Dal Monte save precious metal as compared to round and oval solid cross sectional shapes, it is obvious that hollow links have a potential to save even more precious metal.

It has heretofore proven extremely difficult to take advantage of the asymmetric cross sections of Dal Monte in hollow link form. Such links, if hollow, would be difficult to make, difficult to work with, and easily deformed.

FIGS. *3a–3c*, 4 illustrate a square link 20 of hollow construction that includes three side elements 21–23 joined together at corners 24 of the miter type. A fourth side 26 is interrupted with a central gap 28. As best illustrated in FIGS. *3c* and 4, the cross section 30 of the link 20 is trapezoidal. The two parallel surfaces 32, 34 of the trapezoidal cross section 30 form the outermost surfaces and the innermost surfaces respectively, of a completed double helix rope chain. A seam 36 extends around the inner perimeter of the link and divides the inner surface 34. The trapezoidal shape is completed by converging side surfaces 38.

The link 20 at the illustrated stage in the manufacture of a double helix rope chain includes a solid core 40 of non-precious metal, such as aluminum or copper, and a peripheral shell 42 of precious metal. While the solid core 40 is within the precious shell 42, it is much easier to handle the link 20 without deformation or tearing of the precious metal. Tearing and deformation can be serious manufacturing problems in that the shell thickness may be in the order of 0.0025 inches. Additionally, links may be bent, for example, from an elongated generally trapezoidally shaped wire much more readily when the non-precious metal core 40 is in place. A trapezoidal cross section wire (FIG. 4) can be made by extruding through a trapezoidal die opening a round core that has been given a layer of precious metal.

A plurality of links 20 are intertwined in the known manner to form a double helix rope chain. Then, the solid core of non-precious metal is removed. For example, the core may be melted out after the rope chain is completed, or by action of an acid or caustic substance, the core may be eaten out. Peripheral access to the core is provided by the seam 36 so that the time required for core removal by chemical action is not unnecessarily long. However, it should be understood that the core may be removed from the individual links prior to intertwining. Also, solid links of precious metal may be used with the trapezoidal cross-section.

Figure 5:
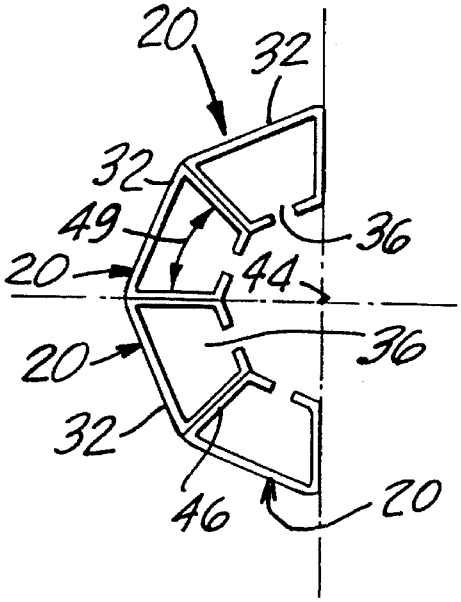
FIG. 5 is a partial end view of a hollow rope chain in accordance with the invention, fabricated from links of FIG. 3*a* in accordance with the invention.

FIG. 5 is an end view of a double helix type rope chain made from the links 20 in accordance with the invention. The cross section is basically circular in the illustrated embodiment because the outer generally flat surfaces 32 of the exposed sides 21, 23 of the links are flat. The illustrated cross sectional area of the rope chain is actually an octagon, but rope chains with different quantities of links in each cycle of the double helix, and different cross-sections may be fabricated, as described in the above mentioned patents.

It will be readily understood by those skilled in the art, that no cross section taken perpendicular to the longitudinal axis 44 of a rope chain is actually circular, octagonal etc. at a particular location due to the winding double helix configuration of the chain. Nevertheless, a view such as FIG. 5 illustrates the relative alignment of adjacent links in the chain in completing one helix cycle (more precisely, one double helix cycle) of 360° measured from a starting point for intertwining of the links, as shown by the length in FIG. 2. Addition of more links adds to the length of the rope chain and repeats the cycle.

The patent to Benhamou (U.S. Pat. No. 4,651,517) describes the factors which determine the quantity N of links that may be required in a helix cycle. The included angle 49 in the link cross section is accordingly approximately 360° divided by N.

As illustrated in FIG. 5, the adjacent links 20 are in abutting contact along planar surfaces 46. Thus, adjacent links, to the extent that they overlap in the longitudinal direction, add support to each other and nest close together. The external appearance is substantially smooth, without indents at the interfaces 46.

Figure 3A:
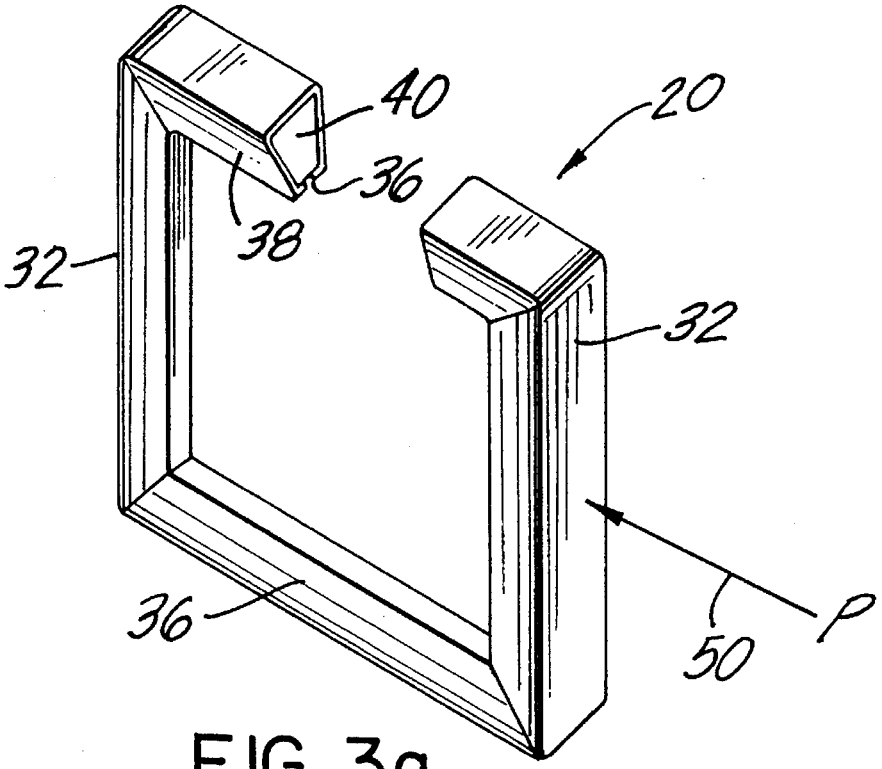
FIG. 3*a* is a top perspective view of a rectangular link for use in fabricating a rope chain in accordance with the invention.

The outer surfaces 32 of the sides 21, 23 are the appearance surfaces of the links 20 and become the most visible surfaces of the completed double helix rope chain. When, in wearing the rope chain, an external force 50 (FIG. 3*a*) is placed upon either of the exposed side elements 21, 23 of the link, there is a tendency for flexure of the side element as a cantilever beam. In such a situation, the outer surface 32 experiences bending in compression and the opposed parallel elements 34 experience tension forces. The thin layer of precious metal, standing alone after the non-precious core has been removed, would quickly fail in tension by tearing except that the inward turned surfaces 34, which complete the trapezoid, provide extra metal to distribute the stresses in the zone where the tension is maximum.

Thereby, the link 20 is stabilized and is much more resistant against deformation due to these external forces 50, as compared to a hollow triangle, especially where the apex of the triangle, at the narrow end, is not joined together by welding or the like.

Thus, the trapezoidal cross section in accordance with the invention provides the advantage of close nesting of the links in the double helix cycle, whereby a smooth external surface is provided. Also, the trapezoidal shape gives strength to the overall link as a beam member, especially in consideration of the seam 36, which is present to expedite manufacturing techniques whereby the solid core is removed during the manufacturing process. A very attractive rope chain that is less subject to damage is the result. Economy in the use of precious metal is further advanced by the hollow construction.

Figure 3B:
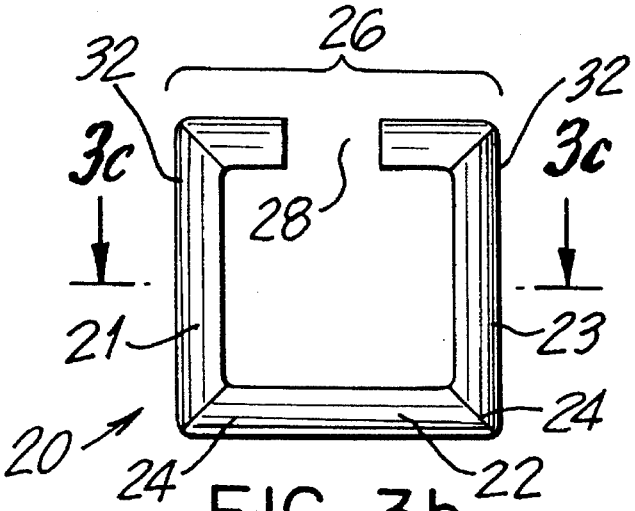
FIG. 3*b* is a front elevational view of the link of FIG. 3*a;*
Figure 3C:
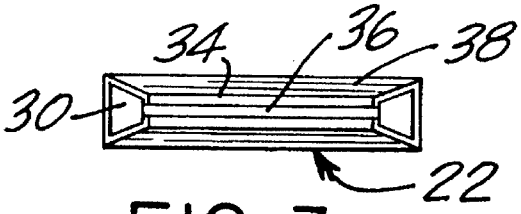
FIG. 3*c* is a sectional view taken along the lines c—c of FIG. 3*b;*
Figure 4:
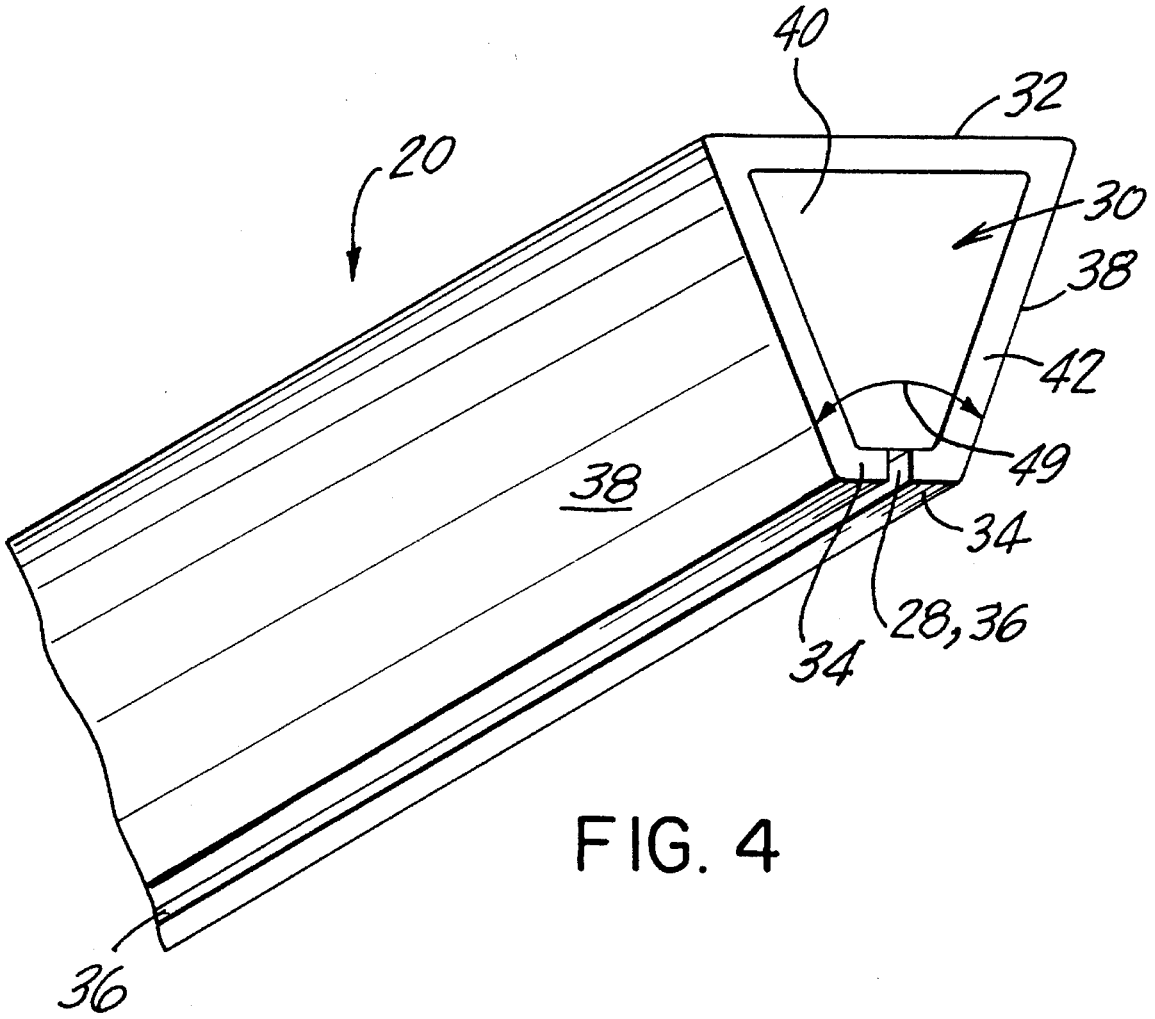
FIG. 4 is an enlarged fragmentary view of the link of FIG. 3*a,* as manufactured.

Although a true trapezoidal shape has been described and illustrated in FIGS. 3–5, it should be understood that in alternative embodiments in accordance with the invention, the link cross section may be varied while retaining only those trapezoidal surfaces that abut along adjacent planar interfaces, and which assure a proper close alignment of adjacent links and a smooth outer surface for the rope chain.

Figure 6:
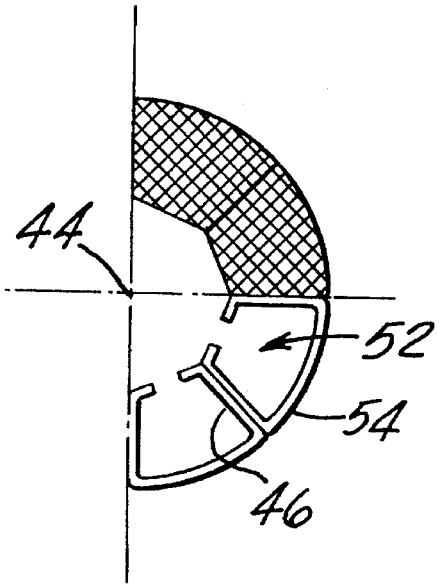
FIGS. 6 and 7 are views similar to FIG. 5 of hollow rope chains using alternative embodiments of links in accordance with the invention.
Figure 7:
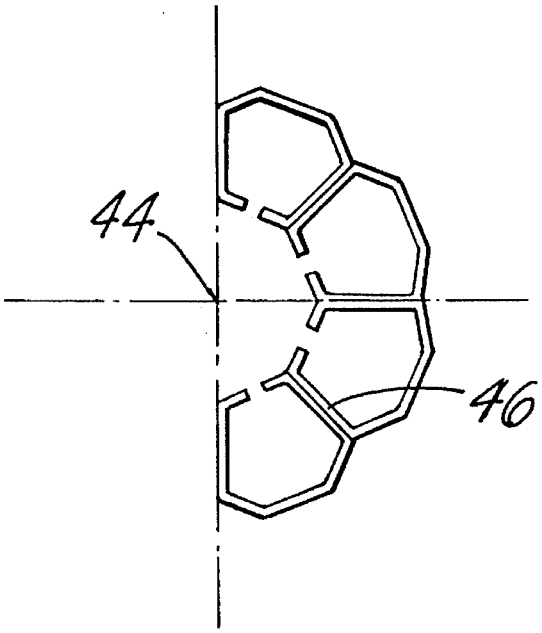

For example, FIG. 6 illustrates a link cross section 52 having an external appearance surface 54 that is circular, having its center at the center line 44 of the rope chain. FIG. 7 illustrates a generally hexagonal cross section for the links, which provides a deliberately grooved appearance for the rope chain. However, the links in FIGS. 6, 7 are tightly packed together as in the previous embodiment. The rope chains of FIGS. 5 and 7 have an outer surface similar to a conventionally diamond cut rope chain.

It will thus be seen that the objects set forth above, among those made apparent from the preceding description, are efficiently attained and since certain changes may be made without departing from the spirit and scope of the invention, it is intended that all matter contained in the above description shall be interpreted as illustrative and not in a limited sense.

What is claimed is:

1. A rope chain, comprising:

a plurality of links, each link being shaped with an open center portion and opposed ends spaced from each other, said links being intertwined to form the appearance of a double helix, each said link having a trapezoidal cross section including a first side parallel to and spaced from a second side, and a pair of convergent sides connecting together ends of said first and second sides, said first side being longer than said second side and forming an outermost peripheral surface of said link and of said rope chain when said links are intertwined, respective convergent sides of adjacent links in said rope chain being in generally planar abutment.

2. A rope chain as in claim 1, wherein said links are hollow.

3. A rope chain as in claim 2, wherein said second side includes a seam extending around an inner periphery of said link.

4. A rope chain as in claim 2, wherein said shaped links include ovals, squares, rectangles, octagons, hexagons and C-shapes.

5. A rope chain as in claim 1, wherein N intertwined links form a single 360° cycle of said double helix rope chain, and an angle included between said pair of convergent sides of said trapezoidal cross section equals approximately 360/N degrees.

6. A rope chain, comprising:

a plurality of hollow links, each link having an open center portion and opposed ends spaced from each other to define a gap in the peripheral shape of the link, said links being intertwined to form a double helix rope chain, each of said links having a cross section including a first side opposed to and spaced from a second side, and a pair of convergent generally straight sides connecting one end of said first side to one end of said second side and connecting the other end of said first side to the other end of said second side, said first side having a length greater than the length of said second side and forming an outermost peripheral surface of said link and of said rope chain when said links are intertwined, said second side forming an innermost peripheral surface of said link, respective convergent sides of adjacent links in said rope chain being in generally planar abutment in the intertwined rope chain.

7. A rope chain as in claim 6, wherein N intertwined links form a single 360° cycle of said double helix rope chain, an included angle between said pair of convergent sides equals approximately 360/N degrees.

8. A rope chain as in claim 6, wherein said first side is convexedly curved away from said second side.

9. A rope chain as in claim 6, wherein said first side includes intersecting linear segments.

10. A rope chain as in claim 6, wherein said first side extends convexedly away from said second side.

11. A rope chain as in claim 6, wherein said second side includes a seam extending around an inner periphery of said link.

* * * * *